US009651249B2

(12) United States Patent
Gosiewski et al.

(10) Patent No.: US 9,651,249 B2
(45) Date of Patent: May 16, 2017

(54) METHOD FOR UTILIZATION OF LOW-CONCENTRATION GAS MIXTURES OF COMBUSTIBLE GAS AND AIR WITH STABLE HEAT ENERGY RECOVERY

(75) Inventors: Krzysztof Gosiewski, Gliwice (PL); Manfred Jaschik, Mikolow (PL); Anna Pawlaczyk, Katowice (PL); Krzysztof Warmuziński, Zabrze (PL); Marek Tańczyk, Gliwice (PL); Krzysztof Gieł zak, Gliwice (PL); Artur Wojdył a, Knurów (PL); Tadeusz Machej, Kraków (PL); Leszek Michalski, Kraków (PL)

(73) Assignees: INSTYTUT INŻYNIERII CHEMICZNEJ POLSKIEJ AKADEMII NAUK, Gliwice (PL); KATALIZATOR Sp. z. o.o., Kraków (PL)

( * ) Notice: Subject to any disclaimer, the term of this patent is extended or adjusted under 35 U.S.C. 154(b) by 1184 days.

(21) Appl. No.: 13/805,167

(22) PCT Filed: Dec. 8, 2011

(86) PCT No.: PCT/PL2011/000128
§ 371 (c)(1),
(2), (4) Date: Dec. 18, 2012

(87) PCT Pub. No.: WO2012/148294
PCT Pub. Date: Nov. 1, 2012

(65) Prior Publication Data

US 2013/0089822 A1 Apr. 11, 2013

(30) Foreign Application Priority Data

Apr. 28, 2011 (PL) ..... 394701

(51) Int. Cl.
*F23G 7/06* (2006.01)
*F23G 5/46* (2006.01)
(Continued)

(52) U.S. Cl.
CPC ..... *F23G 7/068* (2013.01); *F23G 5/14* (2013.01); *F23G 5/46* (2013.01); *F23G 5/50* (2013.01); *F23N 1/002* (2013.01); *F28D 17/02* (2013.01)

(58) Field of Classification Search
None
See application file for complete search history.

(56) References Cited

U.S. PATENT DOCUMENTS 2,121,733 A 6/1938 Cottrell
3,159,450 A * 12/1964 Siggelin ..... B01J 8/001 422/109

(Continued)

FOREIGN PATENT DOCUMENTS

PL 156779 B3 4/1992
PL 165208 B1 11/1994
PL 175716 B1 1/1999

OTHER PUBLICATIONS

European Union Project (Contract No. ICA2-CT-2000-10035): Recovery of methane from vent gases of coal mines and its efficient utilization as a high temperature heat source—Final Report (Institute of Chemical Engineering of the Polish Academy of Sciences), Oct. 2003.

(Continued)

*Primary Examiner* — Gregory Huson
*Assistant Examiner* — Martha Becton
(74) *Attorney, Agent, or Firm* — Rabin & Berdo, P.C.

(57) ABSTRACT

The invention refers to the method for the utilization of low-concentration mixtures of a combustible gas and air (Continued)

Figure 1:
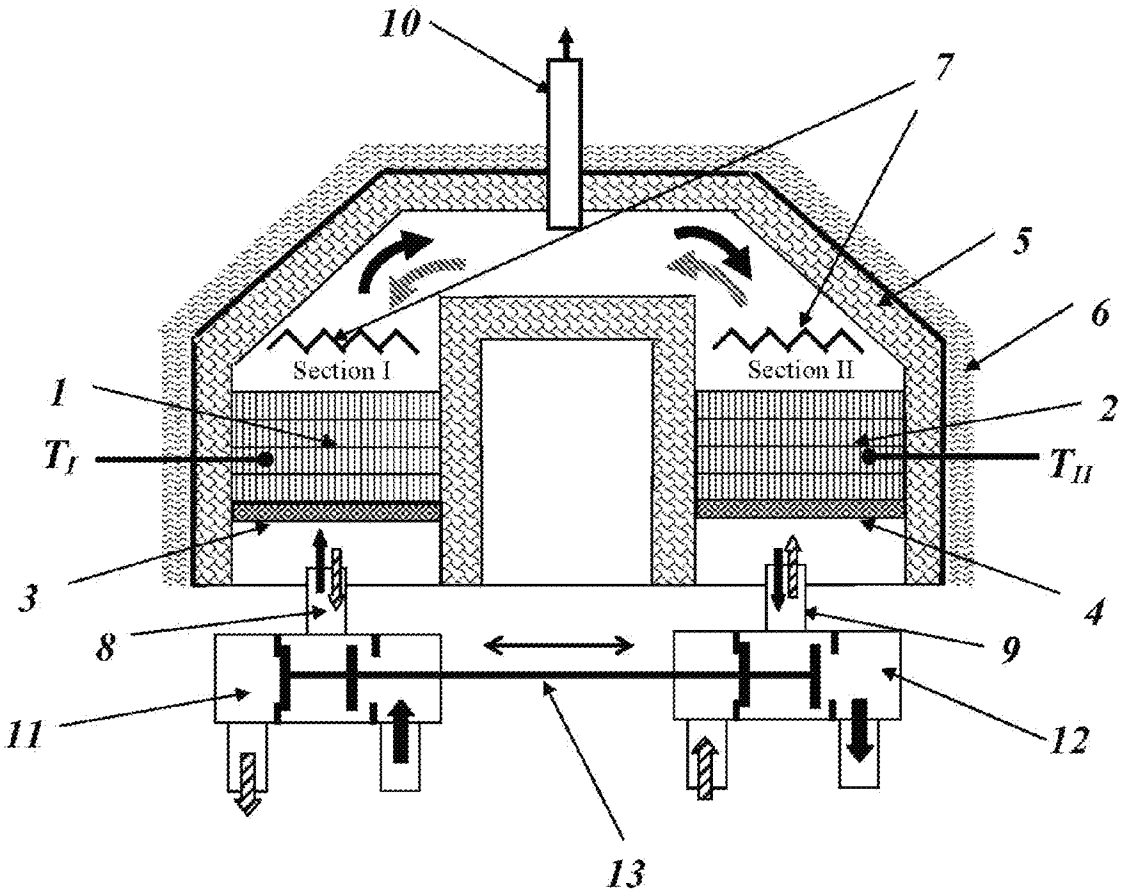

with the stable recovery of heat and the flow-reversal device for the embodiment of the method. The method consists in the combustion, with heat recovery, of the mixtures in the flow-reversal device having at least a single pair of combustion sections, each of which has the structural packing of monolith blocks with small channels characterized by low pressure drop, provided with an internal heating device, temperature and composition sensors and the elements of the automatic control system, supplied with the low-concentration mixture with the combustible component and connected with the heat recovery apparatus through the pipeline, wherein the quantity of energy transferred in the heat recovery apparatus (22) is stabilized by supplying additional fuel to the flow-reversal device, selecting the flow reversal moment, and selecting the flow rate for hot gas supplied by the pipeline to the heat recovery apparatus (22). Additional fuel in the form of highly concentrated fuel mixture is introduced as an admixture to the stream of low concentrated mixture containing the combustible component, supplied to the flow-reversal device or to the internal heating device (7). The device according to the invention, in its combustion sections (I, II) is provided with symmetrical temperature sensors ($T_I$, $T_{II}$) and an additional supply of highly concentrated combustible mixture (17) connected to the supply system for low-concentration mixture (15) with the combustible component or to the internal heating device (7). The combustion sections (I, II) are packed with heat-accumulating material (1,2) of small porosity of the specific surface area below 30 $m^2/g$, and advantageously below 1 $m^2/g$.

15 Claims, 4 Drawing Sheets

(51) Int. Cl.

| | |
|---|---|
| ***F23G 5/50*** | (2006.01) |
| ***F23G 5/14*** | (2006.01) |
| ***F23N 1/00*** | (2006.01) |
| ***F28D 17/02*** | (2006.01) |

(56) References Cited

U.S. PATENT DOCUMENTS

| | | | | |
|---|---|---|---|---|
| 3,207,493 | A | 9/1965 | Swain | |
| 3,870,474 | A | 3/1975 | Houston | |
| 4,478,808 | A | 10/1984 | Matros et al. | |
| 5,080,872 | A * | 1/1992 | Jezl | B01J 8/0285 422/148 |
| 5,366,708 | A | 11/1994 | Matros et al. | |
| 5,540,899 | A * | 7/1996 | Koves | B01J 8/0207 165/104.13 |
| 5,620,668 | A | 4/1997 | Driscoll et al. | |
| 5,768,888 | A * | 6/1998 | Matros | F01N 13/0097 422/170 |
| 5,837,205 | A | 11/1998 | Bayer et al. | |
| 5,874,053 | A | 2/1999 | Chen et al. | |
| 5,997,277 | A | 12/1999 | Heed et al. | |
| 7,591,866 | B2 * | 9/2009 | Bose | B01D 53/24 55/317 |
| 2008/0244975 | A1 * | 10/2008 | Johnston | B01J 19/249 48/197 FM |
| 2012/0269709 | A1 * | 10/2012 | Sapoundjiev | B01D 53/72 423/245.1 |
| 2013/0089822 | A1 * | 4/2013 | Gosiewski | F23G 5/46 431/5 |

OTHER PUBLICATIONS

Gosiewski, K., "Dynamic modelling of industrial SO2 oxidation reactors. Part II. Model of a flow reversal reactor," Chemical Engineering and Processing, vol. 32, No. 4, Aug. 1993, pp. 233-244.

Gosiewski, K., "Efficiency of heat recovery versus maximum catalyst temperature in the reverse-flow combustion of methane," Chemical Engineering Journal, vol. 107, No. 1-3, Mar. 15, 2005, pp. 19-25.

Gosiewski, K. et al., "Effect of the mode of heat withdrawal on the asymmetry of temperature profiles in flow reversal reactors. Catalytic combustion of methane as a test case," Chemical Engineering Science, vol. 62, No. 10, May 2007, pp. 1679-2689.

Gosiewski, K. et al., "Homogeneous vs. catalytic combustion of lean methane-air mixtures in reverse-flow reactors," Chemical Engineering Science, vol. 63, No. 20, Oct. 2008, pp. 5010-5019.

Gosiewski, K. et al., "Utilization of methane contained in ventilation air from coal mine shafts in a thermal flow reversal reactor," Inz. i Ap. Chem. 2010, vol. 49, No. 2, p. 37. (Gosiewski, K , Utylizacja metanu z powietrza wentylacyjnego kopaln wegla kamiennego w termicznym reaktorze rewersyjnym, Inzynieria i Aparatura Chemiczna NrMar. 2010).

Matros, Y. S., Unsteady Processes in Catalytic Reactors, Elsevier, Amsterdam, Sep. 1985.

Matros, Y. S. et al., "Control of Volatile Organic Compounds by the Catalytic Reverse Process," Ind. Eng. Chem. Res., vol. 34, No. 5, May 1995, pp. 1630-1640.

Matros, Y. S. et al., "Reverse-Flow Operation in Fixed Bed Catalytic Reactor," Catalysis Reviews: Science and Engineering, vol. 38, No. 1, Aug. 16, 1996. pp. 1-68.

Salomons, S. et el., "Flow reversal reactor for the catalytic combustion of lean methane mixtures," Catalysis Today, vol. 83, No. 1-4, Aug. 15, 2003, pp. 59-69.

Slepterev, A. A. et al., "Homogeneous high-temperature oxidation of methane," Reaction Kinetics and Catalysis Letters, vol. 91, No. 2, Sep. 2007, pp. 273-282.

Su, S. et al., "An assessment of mine methane mitigation and utilization technologies," Progress in Energy and Combustion Science, vol. 31, No. 2, Mar. 2005, pp. 123-170.

Boreskov, G. K. et al., "Catalytic processes under non-steady-state conditions; I. Switching the direction for the feed of the reaction mixture to the catalytic bed. Experimental Results," Kinetics and Catalysis, vol. 23, No. 2, Mar.-Apr. 1982. Relevancy of the reference can be gleaned from English translation of the Abstract/Summary.

Gosiewski, K. et al., 2001—Kinetyka katalitycznego spalania metanu w mał ym stę ż eniu, Inż ynieria Chemiczna i Procesowa 22. (Kinetics of Catalytic combustion of Dilute Methane-Air Mixtures) vol. 22, pp. 599-612, Jul. 2001. Relevancy of the reference can be gleaned from English translation of the Abstract/Summary, found on the last page.

Gosiewski K. et al.., 2010—Proj. Bad. Rozwoj. Nr R14 020 02: "Termiczne spalanie metanu z górniczych gazów wentylacyjnych w urzą dzeniu rewersyjnym z regeneracją i odzyskiem ciepla spalania" (Coal mine ventilation air methane thermal combustion in the reverse flow apparatus with heat regenration and heat recovery), Oct. 2010.

Hobler, T., Ruch ciepł a i wymienniki, WNT Warszawa (Heat transfer and heat exchangers) pp. 694 and 695, 1971. Relevancy of the reference can be gleaned from the portion of the English translation.

Matros, Y. S., "Catalytic Processes under Unsteady-State Conditions," Studies in Surface Science and Catalysis, vol. 43. Elsevier Science BV, Amsterdam, 1989.

Nieken, U. et al., "Control of the ignited steady state in autothermal fixed-bed reactor for catalytic combustion," Chemical Engineering Science, vol. 49, No. 24B, pp. 5507-5518, 1994.

Rehacek, J. et al., "Modelling of a tubular catalytic reactor with flow reversal," Chemical Engineering Science, vol. 47, No. 9-11, pp. 2897-2902, Jun. 1992.

* cited by examiner

METHOD FOR UTILIZATION OF LOW-CONCENTRATION GAS MIXTURES OF COMBUSTIBLE GAS AND AIR WITH STABLE HEAT ENERGY RECOVERY

The present invention refers to the method for utilization of low-concentration gas mixtures of combustible gas and air with stable consumption of heat energy and a flow reversal for embodiment of the method. The invention refers specifically to the combustion of methane-air mixtures, with $CH_4$ concentrations that can be found in the ventilation air of hard coal mines (the so called Ventilation Air Methane) in a thermal flow reversal device with heat recovery. The method and device according to the invention ensure the utilization of combustion heat in a heat recovery apparatus in the device's operating conditions providing for high combustion efficiency (conversion) and sufficiently symmetric temperature profiles over device packing, as well as stability of energy consumption wherein energy stream delivered to consumers is approximately constant over the period of device's operation.

The use of flow reversal for heat recovery in industrial heat exchangers has had a very long history. Such apparatuses have been known as heat regenerators. Sometimes in such apparatuses, parallel to regenerative heat exchange also chemical reactions have taken place. In the monograph [Hobler, T.,—*Ruch ciepł a i wymienniki, WNT Warszawa* 1986] there is a diagram of a heat regenerator where thermal decomposition of methane with steam takes place. This apparatus, however, is considered by the author a regenerative heat exchanger rather than a flow reversal chemical reactor. In this device heat necessary for endothermic reaction is delivered by the burner located in the upper part of the apparatus, and gas is heated up to 1300° C., which is required for the process, with the regenerative heat exchange, through a cyclical change in the flow direction (the so-called reversal). A similar device has been disclosed in the U.S. Pat. No. 3,207,493, which describes the device for non-catalytic combustion in the form of a furnace with the inlets of preheated gas oxidizer placed in the opposite walls, provided with one off-gas outlet, burners fuelled with gaseous or liquid fuel placed at the inlets of gaseous oxidizer, first and second heat regenerator for alternate absorption of hot combustion by-products and transfer of heat to cold oxidation gases, and a system of two flow reversal valves for the control of flowing gas stream. The device comprises a regenerative heat exchanger, which is not integrated with the reactive area but is a separate element placed in front of the combustion chamber. The first U.S. Pat. No. 2,121,733, quoted by numerous publications on catalytic flow reversal reactors, discloses the manner of heat processing of gas containing combustible pollutants, which comprises pre-heating of the part of the gas-permeable packing material which absorbs heat up to temperature of gas conversion in order to have the gas conversion zone which is situated next to another zone of a temperature lower than the gas conversion temperature and gas passing through with periodic change of the gas flow direction, and an apparatus for heat processing of gas comprising two gas-tight furnaces with heat insulation, each of which has a chamber packing with a loose bed of solid body particles of low heat transfer capacity, an insulated pipe connecting free furnace spaces and forming with them an open transition zone, a set of valves and devices for changing the flow direction of the processed gas. This patent does not name the apparatus a flow reversal reactor explicitly, although in fact it is such a reactor. In the 1970s numerous publications were released where similar devices were called flow reversal reactors or unsteady state with reversed flow reactors. Theoretical grounds for the calculations of such apparatuses are specified among others in the monographs [Matros, Y. S., 1985—*Unsteady Processes in Catalytic Reactors* Elsevier, Amsterdam] and [Matros, Y. S., 1989—*Catalytic Processes under Unsteady Conditions*, Elsevier Science BV, Amsterdam]. The first research works and mathematical models for such reactors—see e.g. [Boreskov, G. K. et al., 1982—*Catalytic processes under non-steady-state conditions; I. Switching the direction for the feed of the reaction mixture to the catalytic bed. Experimental Results, Kinet. Catal.,* 23] or [Gosiewski, K, 1993—*Dynamic modelling of industrial SO2 oxidation reactors Part II. Model of a flow reversal reactor, Chem. Eng. Process.,* 32]—referred to the devices for $SO_2$ oxidation.

From the American U.S. Pat. No. 4,478,808 a method is known of producing sulfur trioxide by oxidation of sulfur dioxide in a stationary reactor with a stationary catalyst bed which is also used as a regenerative heat exchanger.

Such reactors have found some other applications quite quickly, specifically in the combustion of volatile gaseous pollutants, especially volatile organic substances, which is known from the Polish patent no. 156 779 or has been described in the publication [Matros, Y. S., Bunimovich, G. A., 1995—*Control of Volatile Organic Compounds by the Catalytic Reverse Process, Ind. Eng. Chem. Res.,* 34]. From 1980 to 2000, both publications and applications of flow reversal reactors almost exclusively concerned reactors with catalysts, known for example from the U.S. Pat. No. 5,366,708 and U.S. Pat. No. 5,874,053, as well as from the Polish patents no. 165208 and no. 175716.

The patent description no. 165208 discloses the structure of the catalytic flow reversal reactor for gas purification, especially for industrial off-gases, by passing them in the directions alternating in cycles through the layers of catalysts placed between the layers of ceramic lining, composed of two cylindrical bodies, connected with each other by a pipe in their upper part. Inside said bodies, there are concentric perforated cylinders of different diameters, put on each other in such a way that they form ring-like concentric spaces, one of which is packed with a randomly packed catalyst, and the other with recuperative random ceramic packing.

The patent no. 175716 discloses a catalytic flow reversal reactor provided with catalytic-recuperative chambers placed in a single housing or separately, containing the layers of heat accumulation packing and respective catalyst beds belonging to the layers, separated by an empty space, and is provided with a flow reversal gas valve, connected with the catalytic-recuperative chambers and non-reacted gas emitter and connected to the inlet of the flow reversal valve with its pumping side.

In other titles, descriptions or claims of many patents it is not explicitly stated that the solutions refer solely to catalytic solutions, yet applications of flow reversal reactors from this period were mostly the solutions with the use of catalysts, although the flow reversal regenerative solutions, with non-catalytic chemical reaction, were in fact older. At the end of $20^{th}$ century one can notice a return to the solutions with non-catalytic thermal oxidation, which is often explicitly stated in the title of the patents.

The American U.S. Pat. No. 5,620,668 discloses the design of a heat recuperative oxidation device for gas cleaning and a method of combusting the waste gas. In this device gas goes first through the hot bed of the heat exchanger to the high-temperature oxidation chamber (combustion chamber), and then is directed to the second cold bed of the heat exchanger. The apparatus contains the heat recovery columns, insulated from the inside and packed with ceramic material topped with a combustion chamber with insulation on the inside.

The U.S. Pat. No. 5,837,205 describes a bypass system and method using a regenerative thermal oxidizer, where contaminated air first passes through a hot heat-exchange bed and into a high temperature oxidation (combustion) chamber, and then through a relatively cool second heat exchange bed. The apparatus includes a number of internally insulated, ceramic packed heat recovery columns topped by an internally insulated combustion chamber.

Thermal combustion is particularly justified when large quantities of heat are released in the process, and if it can be favorable to recover and utilize reaction heat.

The problem of large volumes of methane emitted in a low-concentration mixture like ventilation air methane has been known in the mining industry for years, yet it was as late as in the last decade of the $20^{th}$ century when serious consideration was given to the methods for utilizing thus obtained fuel. A review of methods used for this purpose can be found in references [Su, S. i in., 2005—*An assessment of mine methane mitigation and utilization technologies, Progress in Energy and Combustion Science,* 31]. Among them, the flow reversal combustion methods are mentioned as promising, both catalytic (the so-called CFRR, Catalytic Flow Reversal Reactors) and thermal (the so-called TFRR, Thermal Flow Reversal Reactors). The works on catalytic combustion of VAM in CFRR have had a long history (over 15 years). The publication [Slepterev, A. A. i in., 2007—*Homogeneous high-temperature oxidation of methane, React. Kind. Catal. Lett.,* 91 (No 2)] mentions the research carried out in the Institute of Catalysis in Novosibirsk as early as in the 1980s. The most extensive research on the use of CFRR for this purpose including semi-technical research, has been conducted for years by the Canadian Research Center CANMET cooperating with the university of Alberta [Salomons, S. et el., 2003—*Flow reversal reactor for the catalytic combustion of lean methane mixtures, Catalysis Today,* 83]. All the works on the use of CFRR for combustion of VAM have never gone beyond the scale of small facilities, having the throughput of between 10 and 20 $Nm^3/h$, most often with the catalysts containing noble metals: Pt—Pd [Salomons, S. et al., 2003—*Flow reversal reactor for the catalytic combustion of lean methane mixtures, Catalysis Today,* 83] or Pd as e.g. in the European project with the participation of the Institute of Chemical Engineering of the Polish Academy of Sciences [2003—*European Union Project* (*Contract No. ICA2-CT*-2000-10035): *Recovery of methane from vent gases of coal mines and its efficient utilization as a high temperature heat source—Final Report*]. The attempts to use cheaper oxide-based catalysts, e.g. Cu—Cr see reference [Gosiewski, K. et al., 2001—*Kinetyka katalitycznego spalania metanu w malym stężeniu, Inżynieria Chemiczna i Procesowa* 22], analyzed in the project [2001-2003—Projekt badawczy KBN nr 3 TO9C 042 18: Katalityczne usuwanie metanu z górniczych gazów wentylacyjnych w reaktorach niestacjonarnych ze wstępnym wzbogacaniem mieszaniny gazowej metodą adsorpcji zmiennociśnieniowej] have shown that their thermal resistance is not sufficient enough to use them in the combustion of VAM. As demonstrated by the experiments in the said project [2003—*European Union Project* (*Contract No. ICA2-CT*-2000-10035): *Recovery of methane from vent gases of coal mines and its efficient utilization as a high temperature heat source—Final Report*], and mathematical simulations, reference [Gosiewski, K. i in., 2008—*Homogeneous vs. catalytic combustion of lean methane-air mixtures in flow reversal reactors, Chem. Eng. Sci.,* 63], the maximum temperature obtained with Pd catalyst in the CFRR during the combustion of VAM can exceed 800° C., and for $MnO_2$ catalyst even 900° C. Having found that in spite of long-time research on CFRR to be used for the combustion of VAM, the catalytic solution does not hold much promise for quick application, attempts have been taken to apply non-catalytic (thermal) combustion in the TFRR, especially that such a solution, parallel to CFRR, has been known for a long time and successfully used for the combustion of volatile organic compounds, for example in flow reversal oxidizers (Vocsidizer) produced by Megtec (USA). TFRR solutions are protected by patents, e.g. the U.S. Pat. No. 5,837,205 and U.S. Pat. No. 5,997,277

The U.S. Pat. No. 5,997,277 discloses a method and device for recovery of energy from a medium containing combustible substances at low concentrations. The method comprises the preheating of the medium in the flow reversal device, where combustion takes place in a warm zone, a housing where entire chemical energy of the fuel is exchanged into thermal energy. Preheated medium is then used for the production of the desired energy form. In the description the problem of VAM combustion has been used as an example of using the invention, which suggests that the patent is especially dedicated to this application.

The research on methane combustion in the demonstration TFRR facility, conducted by the Institute of Chemical Engineering of the Polish Academy of Sciences, for the concentrations similar to those in VAM (see reference [Gosiewski, K. i in., Utylizacja metanu z powietrza wentylacyjnego kopalń węgla kamiennego w termicznym reaktorze rewersyjnym, Inżynieria i Aparatura Chemiczna Nr3/2010]) indicates that around 6 to over 25 $MW_t$ of heating power can be recovered from the air emitted by a single ventilation shaft.

The publication [Gosiewski, K., 2005—Efficiency of heat recovery versus maximum catalyst temperature in the reverse-flow combustion of methane, Chemical Engineering Journal, 107] demonstrates that heat recovery efficiency increases as the maximum temperature in the flow reversal reactor goes up. Therefore, TFRR working at higher temperatures makes it possible to recover more energy than the CFRR based on the use of catalysts, where temperatures are by around 200° C. lower. In flow reversal reactors, two methods for the recovery of heat from the device are usually used, which are denoted as central cooling in the references [Nieken, U. et al., 1994—*Control of the ignited steady state in autothermal fixed-bed reactor for catalytic combustion*, Chem Eng. Sci., 49], if the heat recovery apparatus is located inside the reactor, usually in the middle of its packing, or hot gas withdrawal, if from the central part of the reactor part of gas is withdrawn from the middle section of the reactor to the outside and then directed to the heat receiver (e.g. steam boiler), after which the cooled gas is discharged to the atmosphere via a chimney.

The prior literature [Rehacek, J. et al., 1992—*Modelling of a tubular catalytic reactor with flow reversal, Chemical Engineering Science,* 47] finds a possibility of asymmetric temperature profiles along the flow reversal reactor, and the publication [Gosiewski, K., Warmuzinski, K., 2007—*Effect of the mode of heat withdrawal on the asymmetry of temperature profiles in flow reversal reactors. Catalytic combustion of methane as a test case, Chemical Engineering Science,* 62] proves that the system of hot gas withdrawal is more favorable not only from the structural perspective, but it is also less prone to the formation of such asymmetric temperature profiles during equipment operation. Experimental tests on the experimental facility [Gosiewski K. et al., 2010—Proj. Bad. Rozwoj. Nr R14 020 02: "Termiczne spalanie metanu z górniczych gazów wentylacyjnych w urz ą dzeniu rewersyjnym z regeneracj ą i odzyskiem ciep ł a spalania⇔] have shown that even for heat recovery with withdrawal of part of hot gas, especially for lower methane concentrations, when the reactor operates in a hazardous area from the point of view of maintaining autothermicity, it is still possible that temperature profiles will be asymmetric along the packing of the combustion section of TFRR. The distribution of temperatures in one half of the packing (section) starts to differ from the distribution in another section, which may result (and is likely to result) in combustion extinction, often in the entire half of the reactor packing. Such occurrence is really unfavorable for two reasons: every half-cycle of reversal the temperature of gases introduced into the heat recovery unit is much lower than the temperature introduced during the previous half-cycle, and, moreover, when part of hot stream is withdrawn, every second half-cycle has unreacted substrates in the withdrawn stream, which do not go back to the reactor but are released into the atmosphere. Heat recovery apparatus (e.g. steam boiler) should not work with significant inlet temperature fluctuations, and release of a significant part of non-combusted methane to the atmosphere results in the loss of valuable fuel and is not environmentally friendly. In this situation, any recovery of heat is very inefficient. Every second half-cycle (e.g. every odd half-cycle) significant heating power is withdrawn, and every second half-cycle (e.g. every even half-cycle) such withdrawal is virtually close to zero.

Another problem of the flow reversal reactors are short-term blow-outs of unreacted combustible substrate after each reverse operation, due to the fact that some amount of non-combusted mixture is directed to the stack during the short period directly after the reversal, said mixture previously present in the free cool packing spaces, and then adsorbed on the surface and in the pores of the packing, especially if it is significantly porous. There are different solutions, the purpose of which is to limit or even reduce this phenomenon. The designs of the reverse flow reactors known from U.S. Pat. Nos. 3,870,474 and 5,620,668 disclose the reactor layout with three chambers, where a special system for flow switching is used, where the chamber working before the reversal at the inlet of the cleaned gas is not immediately switched to the outlet one, but for one half-cycle it is switched to the sub-pressure degassing of the packing to remove the pollutant residing in its free spaces and adsorbed on the surface, which is then returned to the inlet of the reactor, and only for the next half-cycle it is switched to the outlet one. Thus, the flow reversal system becomes a three-phase one, with the packing cleaning phase in between the subsequent reversal half-cycles. Such a solution is quite a radical protection against the blow-outs of unreacted substrate, yet at the price of high complexity of the system and its control. Such solutions, offered commercially, e.g. by the multinational Haden Drysys Environmental Ltd are yet much more complex than a double-section flow-reversal reactor and it can be expected that their use is justified only for the removal of very toxic substances and in relatively small facilities. Other methods for elimination of unreacted substrate blow-outs have been described in the U.S. Pat. No. 5,366,708, according to which, in the transition stage of complete change in the gas flow direction, supply gas is introduced into the central zone of the reactor and reacted in the heat exchange zone, and then reacted in the zone which had been preheated before the transition stage. This solution requires quite a complicated design of the reactor. The relatively simple method for blow-outs elimination, disclosed in the aforesaid Polish patent 175716, is effective only partially. Based on simple calculations it can be demonstrated that the amount of fuel blown-out from the free packing spaces and underneath has small impact on the deterioration of average fuel conversion during stable operation of the device. What can have more impact is desorption of fuel adsorbed in the packing pores. The use of small porosity packing reduces this unfavorable phenomenon to a great extent, without a necessity to make the gas circulation system or design of the flow reversal apparatus itself more complex.

The flow reversal reactor applications in environmental protection do often work at strongly changeable flow rates and gas concentrations. Consequently, the withdrawal of heat generated in the process of combusting ventilation air methane from the mine's shaft would fluctuate from virtually zero to even several tens $MW_t$. No local heat consumer would accept such irregular supply of energy, and the transfer of heat back to the system after processing will be subject to objections from electricity distributors. Therefore, stability of equipment operation and amount of utilized energy is an important requirement increasing the usability of energy recovery from such reactors.

The purpose of the solutions according to the invention was to develop the method for utilization of low-concentration mixtures of combustible gas and air with stable energy recovery and to develop the design of the flow reversal equipment for embodying the method, especially for combustion of methane-air mixtures characterized by $CH_4$ concentrations present in the ventilation air of hard coal mines (VAM) in a thermal flow reversal device with heat regeneration. The method and device according to the invention should guarantee the utilization of combustion heat in the heat receiver, in the conditions of equipment operation that ensure high efficiency (conversion) of combustion and sufficient symmetry of temperature profiles along the packing, as well as stable energy withdrawal wherein the stream of energy delivered to customers will be approximately constant during equipment operation. It means that the stream of energy recovered in the heat recovery apparatus, especially in the steam boiler of the device being the object of the invention, in the conditions of highly variable amount of combustible component fed to the reactor, that is when its flow and combustible concentration vary would be more less constant. For such stabilization it can be necessary to periodically or constantly deliver additional fuel when the stream of low-concentration fuel-air mixture introduced into the device according to the invention is characterized by too low a concentration to meet the quantitative requirements of the energy consumer. In the case of VAM combustion, such additional fuel can be methane of higher concentration coming from demethanation of coal mines. Additionally, the method and the device according to the invention should ensure relevant protection against emergency with a risk of VAM explosion or equipment damage.

If heat recovery is realized via a hot gas withdrawal to the heat exchanger, the device being the object of this invention should ensure sufficient combustion conversion not only at the outlet from the device but also at the point where gases are discharged to the heat exchanger. This purpose is obtained by appropriate management of the process in the device, especially in the situations where explicit asymmetry of temperatures along the reactor packing could be observed.

An additional purpose of the invention is to ensure high average combustion conversion by reducing the amount of unreacted component which occurs after temporary blow-outs at the reactor outlet each time after reversal without making the gas flow layout too complicated in the facility with the device by reducing the sorption capacity of the packing, with heat and not mass accumulation as the purpose. According to the invention, this could be done by using the packing of small specific surface area, and therefore with small sorption capacity of combustible species combusted in such reactors.

The essence of the method for utilization of low-concentration mixtures of combustible gas and air with stable heat energy recovery lies in the combustion (with heat regeneration) of the mixtures in the flow reversal device with at least a single pair of combustion sections, each of which has the structural packing of monolith blocks with small channels of low flow resistance, provided with an internal heating device, temperature and composition sensors and automatic control system elements, supplied with low-concentration mixture of combustible gas and air, and connected with a heat recovery apparatus by a pipeline, wherein the volume of energy transferred in the heat exchanger is stabilized by supplying additional fuel to the flow reversal device, selecting the flow reversal moment, and selecting the flow rate of hot gas withdrawn to the heat exchanger. The additional fuel in the form of highly concentrated fuel mixture is introduced as an admixture to the stream of low-concentration mixture with a combustible component, fed to the flow reversal device or to the internal heating device.

Highly concentrated fuel mixture is understood as the mixture with the combustible component concentration much higher than the concentration of the low-concentration mixture utilized in the device, preferably with the concentration of over 30% vol., whereas the low-concentration mixture is understood as concentration of usually below 1% vol.

Flow rate of highly concentrated fuel mixture is adjusted manually or automatically with a valve, depending on the value of the signal with information on the current stream of heat passed to the heat exchanger.

The flow rate of the fuel mixture through flow reversal device and half-cycle time are selected in such a way that at the end of packing the inlet combustion section in each half-cycle, in the stable period of device's operation, conversion of combustible components is not lower than 70%, and favorably above 95%, and so that in the packing of the outlet combustion section no more than 30%, and favorably less than 5% is combusted, and the concentration of carbon monoxide in the hot gas withdrawal is only residual, favorably below 5 ppm.

In the method according to the invention, the fluid flowing through the combustion sections (I and II) of the flow reversal device is favorably distributed in such a way, that no more than 50% of the fluid flows out of the spaces between the combustion sections (I and II) of the flow reversal device, and the remaining fluid flows to the next combustion section. If the flow is realized in such a way that the medium goes first to Section I and then to Section II, then Section I is the inlet section, and Section II is the outlet section. For flow reversal direction, Section II is the inlet section, and Section II is the outlet section.

For energy recovery stabilization it is favorable when the half-cycles duration is selected in such a way that temperature fluctuations in the supply pipe feeding gas to the heat recovery apparatus are in the range from 750 to 1100° C.

To have stable energy recovery and to keep the symmetric temperature profiles in both sections of the device, the method according to the information is implemented in the flow reversal device provided with temperature sensors $T_I$ and $T_{II}$ positioned symmetrically, and the selection of the moment for changing the direction of the flow is realized in such a way that switching between the directions of flow through the device takes place in the constant switching half-cycle, at equal time intervals only if the absolute difference between the temperature measured in the combustion section II at the selected distance from the outlet of the section and the temperature measured at the same distance from the inlet to the combustion section I $|T_{II}-T_I|$ does not exceed the predefined positive value of $\Delta T_{zad,1}$, or, if the combustion section I is the inlet section, the switching takes place when the difference of temperatures $(T_{II}-T_I)$ between the selected temperature in the combustion section II and the selected temperature in the combustion section I reaches the predefined positive value of $\Delta T_{zad,1}$, whereas if the combustion section II is the inlet section, the flow direction is switched when the difference of temperatures $(T_I-T_{II})$ reaches the predefined positive value of $\Delta T_{zad,1}$.

To ensure protection against excessive temperature increase at the outlet of the device according to the invention, the following method for switching the flow direction is used:

if the combustion section I is the inlet section, the flow direction is switched when the selected temperature $T_{II}$ in the combustion section II reaches the positive value of $T_{zad}$ set by the process operator, or if the combustion section II is the inlet section the flow direction is switched when the temperature $T_I$ reaches the set positive value of $T_{zad}$.

In case temperature profiles for the packing of both combustion sections become asymmetric in a significant way, which is indicated by the absolute temperature difference $|T_{II}-T_I|$ being higher than the preset positive value $\Delta T_{zad,2}$, where $\Delta T_{zad,2}>\Delta T_{zad,1}$, the half-cycle duration is extended favorably, where the fluid from the combustion sections of average higher temperatures flows into the combustion section where on average the temperatures are lower, and on the other hand the duration of the half-cycle where the fluid flowing out of the combustion section, where on average temperatures are lower, goes into the combustion section with temperatures higher on average.

In case the duration of the current half-cycle $t_c$ exceeds the allowable value of $t_{c,max}$ that is $(t_c>t_{c,max})$ the flow direction is switched irrespective of the values of temperatures $T_I$ and $T_{II}$ and their absolute difference, and an unusual situation is signaled by an alarm. It is the protection against the situation with a risk of device failure.

In the method according to the invention, the control of the subsequent half-cycles' duration can be done manually and remotely, according to the decisions of the process operator, or automatically.

The method according to the invention can be realized in the flow reversal device according to the invention supplied with a low-concentration mixture of combustible component and air, with a stable energy withdrawal, with the refractory body with external heat coating, accommodating at least a single pair of combustion sections having section I and section II in each pair, connected in the space between sections I and II with the pipeline directing part of the gas mixture to the heat recovery apparatus. Each section has the structural packing, favorably monolith blocks with small channels of low flow resistance, which can be mounted in the ceramic bed, provided with at least one internal heating device, temperature and composition sensors for gas, and the elements of automatic control system, reverse valve and the system for supplying the low concentration mixture with a combustible component, which in the combustion sections are provided with symmetric temperature sensors and additional supply of high-concentration combustible mixture connected with the system for the supply of low concentration mixture with a combustible component or to the internal heating device.

To minimize fuel blow-outs after each reversal it is favorable if the combustion sections of the device according to the invention are packed in with the heat accumulating material of small porosity of the specific surface area lower than 30 $m^2/g$, and favorably below 1 $m^2/g$.

In order to control the quantity of heat withdrawn to the heat recovery apparatus, the device according to the invention has the throttle valve, favorably at the outlet of gases from the heat recovery apparatus. For safety reasons, the device according to the invention is favorably provided with the analyzer and/or the sensor measuring the concentration of the combustible agent, and the member for the cut-off of fuel supply to the mixer.

Figure 2:
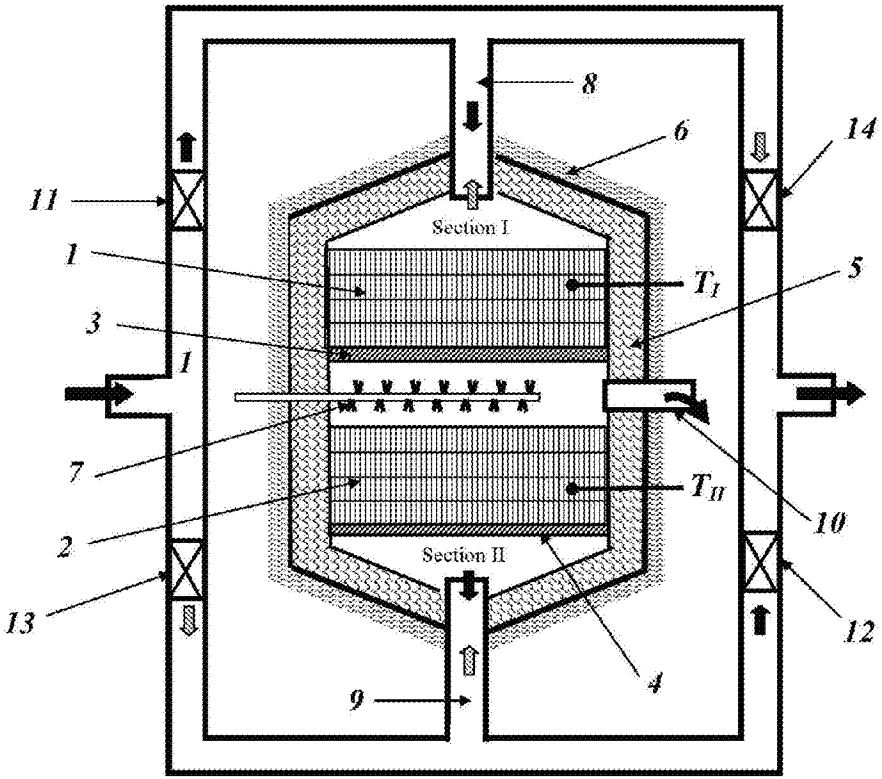
Figure 3:
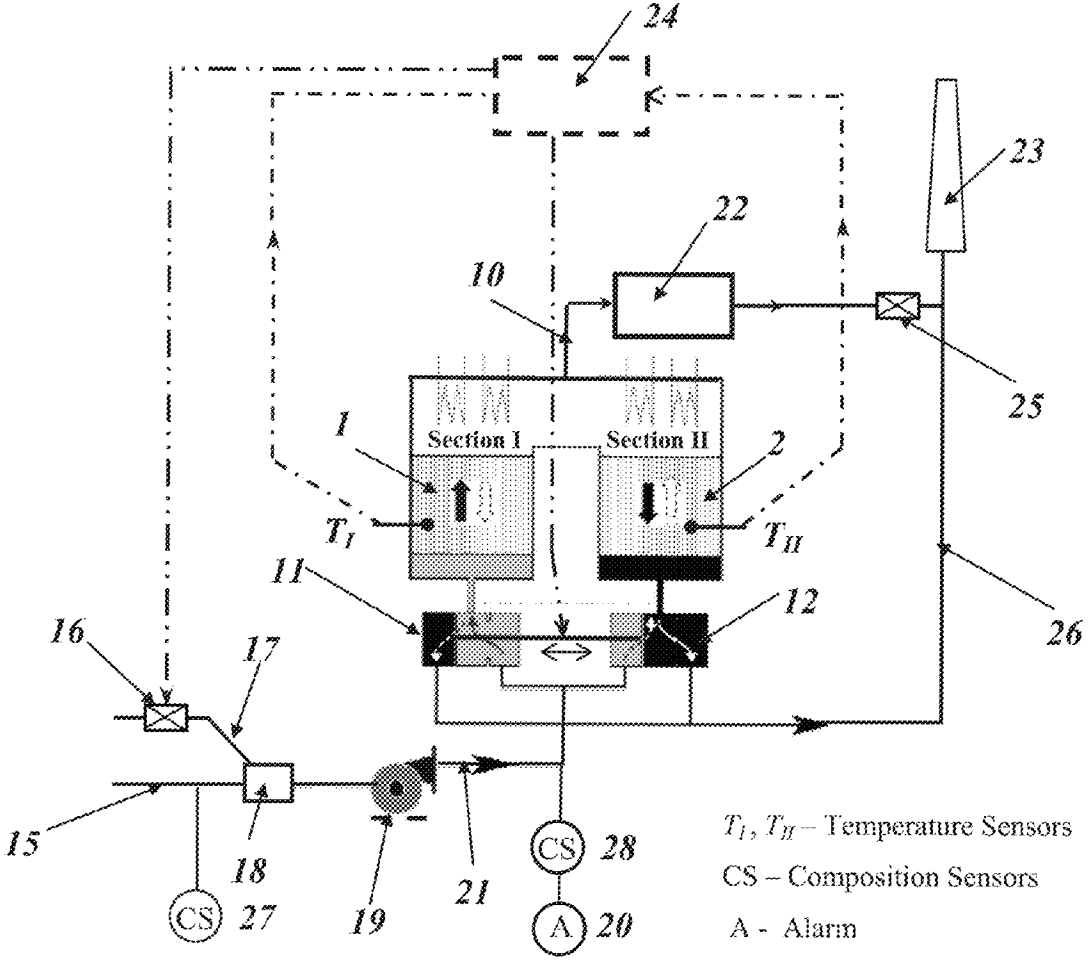
Figure 4:
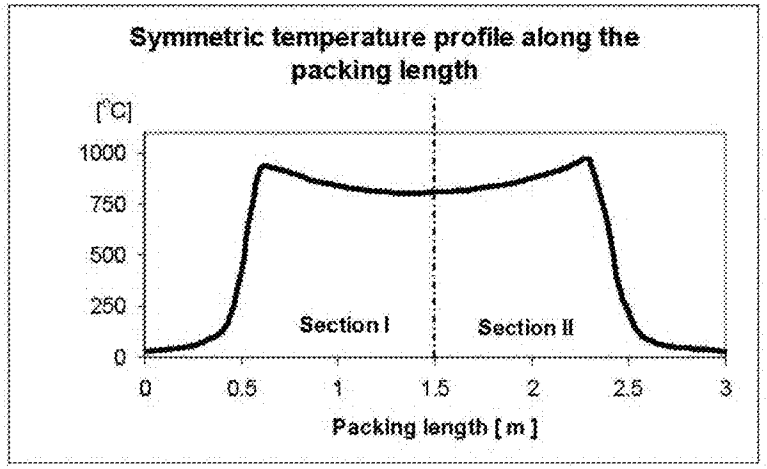
Figure 4:
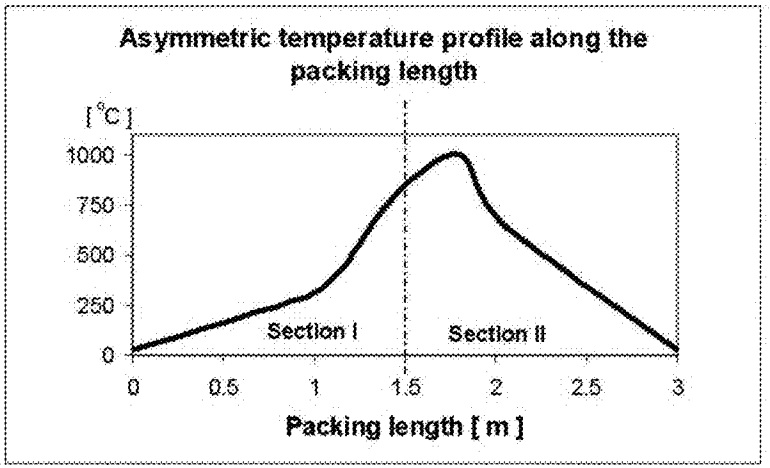

The flow reversal device according to the invention is shown in its embodiments in the drawing, where:

FIG. 1 shows the flow reversal device with two combustion sections located horizontally against each other and with the use of preheating of the packing with electric heaters 7, and FIG. 2 shows the flow reversal device where both sections are located in a vertical way, with preheating using the gas burner, FIG. 3 shows the diagram of the representative installation with the flow reversal device being the subject of the invention, and FIG. 4 shows the profiles of temperature along the packing.

The device according to the invention has the refractory body with external thermal insulation, inside which there are two combustion sections I, II, packed with ceramic blocks of monolith structural packing 1, 2, on the randomly packed bed made of ceramic elements 3, 4 which safeguard the regular distribution of gas in the device. The walls of the flow reversal device are lined with refractory lining 5, and from the outside they are insulated with thermal insulation 6. To initiate the combustion of the combustible component, both sections I, II of the packing are preheated with electric heaters 7 which are shut off once the packing temperature reaches the level enabling the ignition of the mixture with the combustible component. Alternatively, instead of electric heaters 7 gas or oil burners can be used. Heaters in the form of burners can also be used in the situations when the content of the combustible component in the stream fed to the device is too low to meet the requirements of the consumer of the recovered energy, or if due to the sharp decrease in the concentration of the combustible component in the supply stream there is a risk of the shut-down of the device according to the invention.

The device operates with the flow direction changed periodically. If the flow is realized in such a way that the medium flows first to section I, and then to Section II, Section I is the inlet section, and Section II is the outlet section. For opposite direction (first Section II and then Section I) Section II is the inlet section and Section I is the outlet section.

In the flow reversal device shown in FIG. 1 the mixture with the combustible component is fed to the device by the reverse valve 11 through the inlet pipe 8, if the stem of the reverse valves 13 is in the border left side position and then the main outlet of the mixture is through the pipe 9, and the mixture flows out through the right chamber of the valve 12. After some time, referred to as the reversal half-cycle, the stem of the valves 13 is switched to the opposite position and the mixture flows through the left chamber of the valve 12 and flows into the device through the inlet pipe 9 and then the main outlet is the pipe 8 and the left chamber of the valve 11.

A version of the device is the structure shown in FIG. 2. In the solution shown in FIG. 2, the mixture with the combustible component is fed to the device through the pipe 8, if the valves 11 and 12 are open, and the valves 13 and 14 are closed. Then Section I (packing 1 and bed 3) is the inlet section, and Section II (packing 2 and bed 4) is the outlet section. In the opposite half-cycle of reversal, the mixture is fed through the pipe 9 as the valves 13 and 14 are open and the valves 11 and 12 are closed, and then Section II is the inlet section and Section I is the outlet one.

In both versions of the design of the flow reversal device, shown in FIG. 1 and FIG. 2, for operation with heat recovery in both half-cycles of reversal part of the mixture leaves the device through the outlet pipe 10 and this part is directed to the heat recovery apparatus 22, such as a steam boiler.

In the diagram of the installation with the device according to the invention shown in FIG. 3 the air with the low-concentration fuel mixture is supplied by the conduit 15, where, through the valve 16 and conduit 17, highly concentrated additional combustible component is fed. After mixing, the fan 19 pumps the mixture through the conduit 21 to the reverse valve 11 or 12 depending on the current reversal half-cycle. Part of hot gas collected between sections 1 and 2 is directed to the heat recovery apparatus 22, usually a steam boiler where it is cooled down, most often to approx. 200° C. and is directed to the atmosphere through the stack 23. The remaining part of gas flows through the next section of the device and depending on the current half-cycle of reversal through the flow reversal 12 or 11 is directed to the stack 23, and then to the atmosphere. The flow rate of gas directed to the heat recovery apparatus 22 is controlled by the throttle valve 25. As illustrated in FIG. 3, the flow reversal device further has temperature sensors 27, 28.

The stream of gas collected by the pipeline 10 should be such that only little part of heat generated in the combustion process is directed to the stack with gas flowing through the pipeline 26. For this reason the flow reversal device according to the invention, if the heat recovery apparatus 22 collects heat, should operate all the time close to the extinguishing threshold, and its symptom is that in longer and stable periods of equipment operation the average temperature of gas in the pipeline 26 is only slightly higher than the average temperature of gas in the pipeline 21. However, when the addition of the highly concentrated fuel mixture leads to the stabilization of the heat recovered in the apparatus 22, then the flow collected by the pipeline 10 will be more or less constant if only the fluctuations in the temperature of gas taken by the pipeline 10 have more or less constant average value. It is possible to adjust this flow remotely or on site, not automatically but manually. The location of the throttle valve for the adjustment of the flow may be either in front of or behind the heat recovery apparatus. Due to the temperature, in which the throttle valve operates, it is more favorable to put it behind the apparatus 22, as shown in FIG. 3.

The method for utilization of low-concentration mixtures of combustible component and air with the stable heat recovery according to the invention can be for example realized fully or partly automatically through the use of the controller 24.

Stabilization of the quantity of energy recovered in apparatus 22 (e.g. steam boiler) can be obtained with the signal from the controller 24 in two ways: adding highly concentrated fuel mixture fed with the pipeline 17 to the gas flowing through the conduit 18 in the mixer, e.g. for VAM combustion-methane mixture obtained during demethanation of the coal seam, so that regulation with the valve 16 of the concentration of fuel fed to the device through the pipeline 21 stabilizes the generated combustion energy and the quantity of energy collected from the device in the heat recovery apparatus 22. Alternatively, a similar quantity of fuel can also be supplied directly to the burner 7 shown in FIG. 2, which in such a solution would serve not only for preheating of the bed but also for stabilization of the quantity of energy collected from the device. The quantity of energy transported to the apparatus 22 can be approximated as the product of flow rate of the medium transported by the pipeline 10 and its temperature, given that the temperature of gas after the apparatus 22 is more less constant. More accurate methods for determining the quantity of heat utilized in the apparatus 22 can also be used.

When highly concentrated fuel mixture is fed to the mixer 18 by the valve 16, the concentration of the combustible component fed to the flow reversal device with the pipeline 21 is controlled by the analyzer or the fuel concentration sensor 20 provided with an alarm function. The alarm threshold is set to keep the concentration of the mixture fed to the device suitably below the preset mixture explosion threshold. When the threshold is exceeded, a risk of emergency occurs and therefore once the alarm system is activated, the valve supplying fuel through the pipeline 17 to the mixer is closed. The supply of highly concentrated fuel can be closed with the valve 16 or with another cut-off valve. In such situations, after the alarm and fuel cut off, one should switch to manual control, which consists mainly in the reduction of the preset heat transfer value in the apparatus 22 and reduction in the discharge of gases through the pipeline 10, controlled by the throttle valve 25. After adjustment of the discharge it is possible to restore the supply of highly concentrated fuel through the pipeline 17 to the mixer 18 and then to return to the automatic control mode. It is favorable to use a warning alarm after the preset alarm threshold is exceeded, which is a bit lower than the alarm causing the cut-off of the fuel supply of highly concentrated fuel to the mixer.

In both alternatives of the flow reversal device, both from FIG. 1 and FIG. 2, at the same distances from the inlet to the inlet section of the packing 1, 2 and outlet from its outlet Section there are temperature sensors $T_I$ and $T_{II}$, the readings of which are used for the selection of the moment when to reverse the flow.

In known flow reversal devices, control of the reversal system is effected by the presetting of the constant value of the half-cycle duration, or by switching after the preset value of temperature differences ($T_{II}-T_I$) or ($T_I-T_{II}$) is exceeded depending on the current flow direction. Both control methods do not make it possible to sufficiently avoid the asymmetric operation of the device, and hence to meet the requirement of the stable heat recovery for the purpose of its utilization.

The moment of switching the flow direction, that is the reversal in the method according to the invention, is selected by using the information on the selected temperature values in the flow reversal device according to the invention, or on the values of the differences between the temperatures and the knowledge of the current direction of the flow of the gas mixture through the device:

Example: the control system 24 in the automatic control mode selects the moment of the flow direction change in such a way that the change in the direction of flow through the flow reversal device is made in the constant switching half-cycle (at equal time intervals) if the absolute difference between the temperature measured in Section II at the selected distance from the outlet from the section and the temperature measured at the same distance from the inlet to Section I $|T_{II}-T_I|$ does not exceed the preset value $\Delta T_{zad,1}$, or the switching is made once the difference in temperatures ($T_{II}-T_I$) between the selected temperature in Section II and selected temperature in Section I exceeds the preset positive value $\Delta T_{zad,1}$, if Section I is the inlet section or once the difference in temperatures ($T_I-T_{II}$) reaches the preset positive value $\Delta T_{zad,1}$, if Section II is the inlet section. Consequently, in the periods when the heating profile of Sections I and II is more less symmetric, the duration of both half-cycles is equal or approximately equal.

If for any reason the temperature profiles of both beds become significantly asymmetric, which is indicated by the absolute temperature difference $|T_{II}-T_I|$ exceeding the preset positive value of $\Delta T_{zad,2}$, where $\Delta T_{zad,2}>\Delta T_{zad,1}$, the control system 24, in the automatic control mode extends the half-cycle duration, where the fluid from the Section of higher temperatures on average flows into the Section with temperatures lower on average, and shortens the half-cycle duration where the fluid flowing from the section of the temperatures lower on average flows into the Section of the temperatures higher on average and thus facilitates the restoration of the symmetric temperature profiles in the reactor.

The control system 24 may also facilitate the restoration of the symmetric temperature profiles in the device by remote manual control, with setting up the predefined durations of the half-cycles, different for each direction of flow through the device.

When, due to different disturbances, in the automatic control mode, e.g. when the control is in based on the difference of temperatures $T_I$ and $T_{II}$, the duration of flow in one direction is excessively long which usually leads to the formation of asymmetric temperature profiles, then it is necessary to reverse after some maximum duration of a single half-cycle $t_{c,max}$ while flowing in one direction is exceeded, wherein said maximum value is determined by experiments for a given object. So if in the automatic control mode the duration of the current half-cycle $t_c$ exceeds the allowable duration $t_{c,max}$, that is ($t_c>t_{c,max}$), then the control system 24 reverses the flow, irrespective of the temperature values $T_I$ and $T_{II}$.

TABLE 1

Research and demonstration plant (results for the flow rate of around 400 $m^3_{STP}$/h)

| $CH_4$ concentration % vol. | $CH_4$ conversion % | Discharge of hot gas for utilization % | Discharge temperature ° C. | Heat recovery per 100k $m^3_{STP}$/h $MW_t$ |
|---|---|---|---|---|
| 0.1 | | reactor extinguishes | | |
| 0.22 | 87 | 0 | — | 0 |

TABLE 1-continued

| Research and demonstration plant (results for the flow rate of around 400 $m^3_{STP}/h$) | | | | |
|---|---|---|---|---|
| $CH_4$ concentration % vol. | $CH_4$ conversion % | Discharge of hot gas for utilization % | Discharge temperature ° C. | Heat recovery per 100k $m^3_{STP}/h$ $MW_t$ |
| 0.35 | 85 | 0 | — | 0 |
| 0.42 | 90 | 2.3 | 863 | 0.6 |
| 0.75 | 96 | 9.9 | 905 | 2.8 |
| 1.0 | 97 | 17.4 | 950 | 5.3 |

The method according to the invention has been realized using the research and demonstration plant of the VAM flow rate of up to about 400 $m^3_{STP}/h$. The summary of the experimental results is shown in the Table 1, where heat recovery from the installation has been recalculated for the flow rate of 100 k $m^3_{STP}/h$ of the VAM feed mixture.

The studies revealed that the reasonable volumes of heat for utilization are obtained for the concentrations of over 0.4% vol. of $CH_4$ in the stream supplying the TFRR. Therefore, from this perspective, the application of additional fuel mixture in the method according to the invention seems justified in cases when methane concentration in the inlet stream of the device is lower than 0.4% vol.

During the experiments much attention was given to the formation of temperature asymmetries which can occur in the flow reversal device according to the invention. The charts shown in FIG. 4 show the actual examples of symmetric and asymmetric profiles measured during the operation of the flow reversal device in the experimental installation.

The symmetric profile shown in FIG. 4 has been formed during the operation of the device supplied with the mixture of the concentration of 1% vol. of $CH_4$, without any withdrawal of hot gas for utilization, whereas the profile shown next to it, clearly asymmetric, has been formed during the supply with the mixture of the similar concentration but in the situation when around 15% of the total gas quantity has been discharged by the vent from the connector between the sections of the device.

A suitable operation of the process using the method according to the invention makes it possible to avoid the formation of asymmetry that can have a very unfavorable influence on the stability of heat recovery in the apparatus 22.

The method according to the invention that can be realized in the flow reversal device according to the invention makes it possible to purify ventilation gases from underground mining, and to purify the off-gases produced in oil and coke industries, said gases containing undesirable combustible components, and also makes it possible to produce heat energy in a stable way and deliver it to consumers so that it can be utilized efficiently.

The invention claimed is:

1. A method for utilization of low-concentration mixtures of combustible gas and air with a stable recovery of heat energy, the method comprising:

providing a heat recovery apparatus and a flow reversal device that includes a pair of combustion sections that each have therein a structural packing of monolith blocks having small low flow resistance ducts, the pair of combustion sections having a first combustion section and a second combustion section, the flow reversal device further having temperature sensors, composition sensors, an internal heating device and an automatic control device, the temperature sensors being in the pair of combustion sections and are symmetrical temperature sensors, the flow reversal device being connected by a pipeline to the heat recovery apparatus;

supplying the low-concentration mixtures to the flow reversal device;

flowing a fluid, including the low-concentration mixtures, in the flow reversal device;

combusting, with heat regeneration, the low-concentration mixtures in the flow reversal device; and stabilizing a quantity of energy given off in the heat recovery apparatus by the following steps:

a. supplying additional fuel to the flow reversal device, b. selecting a flow reversal moment when the flow is reversed in the flow reversal device, a moment of the reversing the flow is selected in such a way that switching a flow direction of the flow in the reverse flow device is realized in the following way:

in a constant switching half-cycle, reversal in the flow direction is made at equal time intervals, if an absolute difference between a temperature measured in the second combustion section at a selected distance from an outlet of the second combustion section and a temperature measured in the first combustion section at the same distance from an inlet to the first combustion section $|T_{II}-T_I|$ does not exceed or does not reach a preset positive value of $\Delta T_{zad,1}$, or if the first combustion section is an inlet combustion section that receives the low-concentration mixtures before the second combustion section, a reversal in the flow direction is made at a time when a temperature difference $(T_{II}-T_I)$ between the temperature in the second combustion section and the temperature in the first combustion section reaches the preset positive value $\Delta T_{zad,1}$, or if the second combustion section is the inlet combustion section that receives the low-concentration mixtures before the first combustion section, the flow is reversed once a temperature difference $(T_I-T_{II})$ between the temperature in the first combustion section and the temperature in the second combustion section reaches the preset positive value $\Delta T_{zad,1}$, and c. selecting a flow rate for gas, discharged from the flow reversal device, supplied by the pipeline to the heat recovery apparatus.

2. The method of claim 1, wherein the additional fuel is in the form of a highly concentrated fuel mixture, and said step a of supplying the additional fuel includes introducing the highly concentrated fuel mixture as an admixture to the low-concentration mixtures while the step of supplying the low-concentration mixtures to the flow reversal device occurs.

3. The method of claim 2, wherein said step a of supplying the additional fuel further comprises adjusting a flow rate of the highly concentrated fuel mixture, the flow rate of the highly concentrated fuel mixture being adjusted manually or automatically by a valve, depending on a value of a signal that indicates information on a current heat stream transfer in the heat recovery apparatus.

4. The method of claim 1, further comprising:

selecting a flow rate of the low-concentration mixtures in the flow reversal device; and selecting a duration of a reversal half-cycle of the flow reversal device in a way so that in the fluid, which is flowing between the pair of combustion sections, in each half-cycle and in a stable period of device operation, a conversion of combustible components is at least over 70%, a concentration of carbon monoxide in the gas discharge from the flow reversal device is below 5 ppm.

5. The method of claim 1, wherein the fluid, which is flowing between the pair of combustion sections, is distributed in such a way in a space between the pair of combustion sections so that the heat recovery apparatus receives through a passage, no more than 50% of the fluid and a remaining part of the fluid flows from one of the pair of combustion sections to the other of the pair of combustion sections.

6. The method of claim 1, further comprising sending the low-concentration mixtures through the pair of combustion sections, wherein the pair of combustion sections have heat-accumulating material that includes porosity of a surface area that is below 30 $m^2/g$.

7. The method of claim 1, further comprising selecting a duration of half-cycles of the flow reversal device in such a way that temperature fluctuations in a space between the pair of combustion sections is in a range from 750 to 1100° C.

8. The method of claim 1, wherein if the first combustion section is an inlet combustion section that receives the low-concentration mixtures before the second combustion section, the flow direction is reversed once a temperature of the second combustion section reaches a positive value ($T_{zad}$) that is preset by a process operator, or if the second combustion section is the inlet combustion section that receives the low-concentration mixtures before the first combustion section, the flow direction of the flow is reversed once a temperature of the first combustion section reaches the preset positive value ($T_{zad}$).

9. The method of claim 1, wherein in case of asymmetry in temperature profiles of the pair of combustion sections, which is indicated by the absolute temperature difference $|T_{II}-T_I|$ between the temperature of the first combustion section and the temperature of the second combustion section exceeding a preset positive value of $\Delta T_{zad,2}$, where $\Delta T_{zad,2}>\Delta T_{zad,1}$, a duration of a half-cycle in which fluid from one of the pair of combustion sections with higher average temperatures than the other of the pair of combustion sections flows into the other combustion section with lower average temperatures is extended, and a duration of a half-cycle in which the fluid flowing out of the other combustion section to the one combustion section is shortened.

10. The method of claim 9, further comprising signaling with an alarm a flow direction reversal that takes place irrespective of the temperature values ($T_I$ and $T_{II}$) and their absolute difference in case a duration of a current half-cycle $t_c$ exceeds an allowable $t_{c,max}$ value.

11. The method of claim 10 wherein a duration of subsequent half-cycles in the reverse flow device is controlled remotely in a manual mode depending on a decision of the process operator, or automatically.

12. The method of claim 1, further comprising sending the low-concentration mixtures through the of combustion sections, wherein the pair of combustion sections have heat-accumulating material that includes porosity of a surface area that is below 1 $m^2/g$.

13. The method of claim 4, wherein at the ends of the monolith blocks at the inlets of the pair of combustion sections, in each half-cycle and in the stable period of device operation a conversion of combustible components is over 95%.

14. A method for utilization of low-concentration mixtures of combustible gas and air with a stable recovery of heat energy, in a heat recovery apparatus and a thermal flow reversal device that includes a pair of combustion sections that each have therein a structural packing and the pair of combustion sections have a symmetrical pair of temperature sensors $T_I$ and $T_{II}$, the method comprising:

selecting a flow reversal moment when a flow is reversed in the flow reversal device in such a way that the switching a flow direction in the reverse flow device is realized in the following way:

in a constant switching half-cycle, at regular time intervals, if an absolute difference between a temperature measured in a second of the combustion sections at a selected distance from an outlet of the second combustion section and a temperature measured in a first of the combustion sections at the same distance from an inlet to the first combustion section I $|T_{II}-T_I|$ does not exceed or does not reach a preset positive value of $\Delta T_{zad,1}$, or if the first combustion section I is an inlet combustion section that receives the low-concentration mixtures before the second combustion section, a reversal in the flow direction is made at a time when a temperature difference ($T_{II}-T_I$) between the temperature of the second combustion section and the temperature in the first combustion section reaches the preset positive value $\Delta T_{zad,1}$, or if the second combustion section II is the inlet combustion section that receives the low-concentration mixtures before the first combustion section, the flow is reversed once a temperature difference ($T_I-T_{II}$) between the temperature of the first combustion section and the temperature of the second combustion section reaches the preset positive value $\Delta T_{zad,1}$.

15. A method for utilization of low-concentration mixtures of combustible gas and air with a stable recovery of heat energy, the method comprising:

providing a heat recovery apparatus and a flow reversal device that includes a pair of combustion sections that each have therein a structural packing of monolith blocks having small low flow resistance ducts, the flow reversal device further having temperature sensors, composition sensors, an internal heating device and an automatic control device, the flow reversal device being connected by a pipeline to the heat recovery apparatus;

flowing a fluid, including the low-concentration mixtures, in the flow reversal device;

combusting, with heat regeneration, the low-concentration mixtures in the flow reversal device by sending the low-concentration mixtures through the combustion sections while limiting adsorption of gas components on a surface of heat-accumulating material of the combustion sections where a possible adsorption of uncombusted components on the surface of the heat accumulating material is limited by a specific surface area of the heat-accumulating material being below 30 $m^2/g$; and stabilizing a quantity of energy given off in the heat recovery apparatus by the following steps:

a. supplying additional fuel to the flow reversal device, b. selecting a flow reversal moment when the flow is reversed in the flow reversal device, and c. selecting a flow rate for gas, discharged from the flow reversal device, supplied by the pipeline to the heat recovery apparatus.

* * * * *